United States Patent [19]

Becker et al.

[11] Patent Number: 4,813,188

[45] Date of Patent: Mar. 21, 1989

[54] METHOD OF SHAPING WORKPIECES ESPECIALLY FORMING UNDERCUT ARCHIMEDEAN SPIRALS

[75] Inventors: Georg Becker, Braunfels; Herbert Basilowski, Spardorf, both of Fed. Rep. of Germany

[73] Assignee: Buderus Aktiengesellschaft, Wetzlar, Fed. Rep. of Germany

[21] Appl. No.: 874,221

[22] Filed: Jun. 13, 1986

[30] Foreign Application Priority Data

Jun. 27, 1985 [DE] Fed. Rep. of Germany ..... 3522977

[51] Int. Cl.[4] ..... B24B 3/22

[52] U.S. Cl. ..... 51/288; 51/97 NC; 51/105 EC; 51/94 CS; 51/165.71

[58] Field of Search ..... 51/288, 97 NC, 105 EC, 51/72 R, 95 LH, 95 WH, 94 CS, 327, 165.71, 48 HE

[56] References Cited

U.S. PATENT DOCUMENTS

| | | | |
|---|---|---|---|
| 2,054,364 | 9/1936 | DeLeeuw | 51/105 EC |
| 3,905,156 | 9/1975 | Vogelsanger | 51/288 |
| 4,186,529 | 2/1980 | Huffman | 51/288 |
| 4,222,362 | 9/1980 | Kaiser | 51/165.87 |
| 4,358,911 | 11/1982 | Vogelsanger | 51/288 |
| 4,631,870 | 12/1986 | Sun | 51/165.71 |

FOREIGN PATENT DOCUMENTS

| | | | |
|---|---|---|---|
| 0743646 | 11/1943 | Fed. Rep. of Germany | 51/206 P |
| 0746064 | 11/1944 | Fed. Rep. of Germany | 51/288 |
| 2810562 | 9/1979 | Fed. Rep. of Germany | 51/105 EC |

*Primary Examiner*—James G. Smith
*Assistant Examiner*—Robert A. Rose
*Attorney, Agent, or Firm*—Herbert Dubno

[57] ABSTRACT

Hitherto mechanical lever systems and cams were used to effect the necessary relative movements between the workpiece and the grinding disc. In order to attain a higher production rate at improved quality, it is proposed to use electronic means for shaping the profile of a tool. The generating profile is once or several times provided in a convex configuration on the grinding disc. The workpiece is shaped by respectively definable translatory, rotatory and angularly-dependent relative positions between the workpiece and the grinding disc.

4 Claims, 2 Drawing Sheets

METHOD OF SHAPING WORKPIECES ESPECIALLY FORMING UNDERCUT ARCHIMEDEAN SPIRALS

FIELD OF THE INVENTION

Our present invention relates to a method of generating a profile on workpieces such as cutters which can machine spirals or helices on milling cutters or drill bits.

More particularly, this invention is directed at the provision of a method which serves to produce helically arranged undercuts, hereinafter also referred to as archimedean undercuts, i.e. formations which present cutting edges, as are found, for example, in cutting tools, such as mills, drill bits, tools which cut or machine screw threads and the like the archimedean spiral generating a rake extending away from the cutting edge.

BACKGROUND OF THE INVENTION

Mechanical means were hitherto utilized in the production of the desired profile at the tool or workpiece, for example, when forming such archimedean undercuts with a grinding wheel or disc, at the thread milling cutters or drills. Thus, a cam disc has been used on the circumference of which is provided a grinding curvature which is used to shape the respective workpiece and, by way of a lever system, are therethrough generated the necessary strokes or lifting motions of the workpiece or of the grinding disc.

As a result of attendant mass and vibrational problems of the moving bodies and masses, for example, involving translatory or similar reciprocating movements, the operational speed and the quality are subject to limits set in conformity with the mechanical lever system.

When investigating respective limits of an undercut produced with mechanically controlled operational means it was found, for example, that the upper limit was at about 1500 strokes or lifts per minute. At this upper limit, vibrations of excessive magnitude were experienced, which substantially preclude a higher rate of the strokes or operational movements. Furthermore, retooling for a greater variety of different workpieces becomes cumbersome.

OBJECTS OF THE INVENTION

It is an object of this invention to provide a method of shaping tools, such as, for example, for forming male and female type screw threads, and the like formations.

It is also an object of this invention to provide a method of shaping complexly configured undercuts at a high rate of production and with constant accuracy of the contour and of the surface finish.

SUMMARY OF THE INVENTION

The foregoing and other objects are attained in accordance with the invention thereby, that the curved undercut is formed one or more times in convex manner on the circumference of the grinding disc. The profile configuration for the respective workpiece is attained in conformity with such grinding disc by a transfer process which includes control of the angular synchronization of the grinding disc and the workpiece, as well as by control of synchronization during advance, in the longitudinal direction, of the respective workpiece in conformity with the pitch, and the rotation of the workpiece.

The underlying principle precludes cyclical translatory movements during the grinding operation. Accordingly, one can attain grinding velocities of 60 m/sec and greater.

Utilization of electronic control drive means allows the relative coordination of and engaging and disengaging of associated axes, or the respective shafts thereof, without loss of the attendant interrelationships. Thus rough grinding and finishing or fine-quality grinding can be carried out under optimal conditions and with a high degree of precision.

DESCRIPTION OF THE DRAWING

The above and other objects, features and advantages will become apparent from the following description, reference being made to the accompanying drawing in which.

SPECIFIC DESCRIPTION

Figure 1:
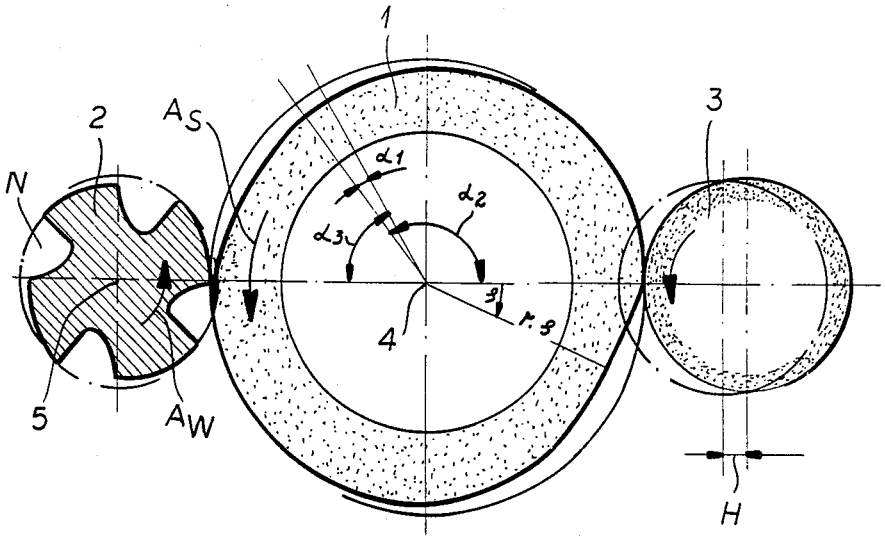
FIG. 1 is a diagrammatic presentation in transverse direction of three electronically coupled axes, respectively of the trimming wheel, grinding disc and workpiece.

The grinding wheel or disc 1 is provided at its circumference with an undercut grinding contour or curve which is such that it can be imparted to the workpiece 2, say a drill or a tap, i.e. a tool having threads on it and which is fluted to give cutting edges, for forming interior or female screw threads. A diamond or similar hardfaced trimming disc 3 is employed to produce the grinding or undercut profile of the grinding disc 1. Hereinafter, the grinding profile of the grinding disc 1 is also referred to as the generating or machining profile. Likewise, the profile transferred onto the workpiece 2 is also referred to as imparted undercut or archimedean undercut.

Accordingly, the trimming disc 3 is brought by corresponding drives, i.e. drives M4 and M5 (as well as M7) into the respectively desired position with respect to the rotary grinding disc 1. Synchronization is ensured by way of an electronic control generally identified by reference numeral 20, including CNC control and electronic drive/transmission means. The respective distance indicated by H in FIG. 1, which can be traversed by the trimming disc 3, corresponds to the peripherally disposed, convex generating profile on the grinding disc 1.

The machining profile can be present once, or several times, on the circumference of the grinding disc 1. A dual copy of the generating profile is indicated in FIG. 1. The tap tool, in turn, is shown as having as the resultant profile four undercuts or fluted cutting edges separated by grooves N when considered in the transverse cross section shown in FIG. 1.

Only the trimming disc 3 carries out a lifting or eccentric motion when the desired profile generation is done by the grinding disc 1. During the actual grinding, however, the grinding disc 1 and the workpiece 2 rotate in synchronized manner about or with reference to the axes of rotation, i.e. axis 4 of the grinding disc 1 and the axis 5 of the workpiece 2. The grinding disc 1, due to its convex profile on its circumference, carries out a relative movement with respect to the longitudinal axis or axis of rotation 5 of the workpiece 2.

In general terms, the generating profile is present two times on the grinding disc 1 when considered in the cross section of FIG. 1. The generating profile is a function of the form $r=f(\alpha,k)$, wherein k is the number of occurrences of the convex generating profile about the full circumference of 360°, i.e. in the present example the value for k=2.

A safety region is indicated by the arc embraced by the sides of the angle 60 $_1$. In turn, $\alpha_2$ is indicative of the region which is inclusive of the safety region as well as the region which corresponds to the respective generating profile or portion thereof. The angle $\alpha_3$, in turn, is representative of the region which is inclusive of the safety region as well as the region which is reserved for the respective groove. At the groove section, the generating profile is returned again to the starting point $A_S$.

Figure 2:
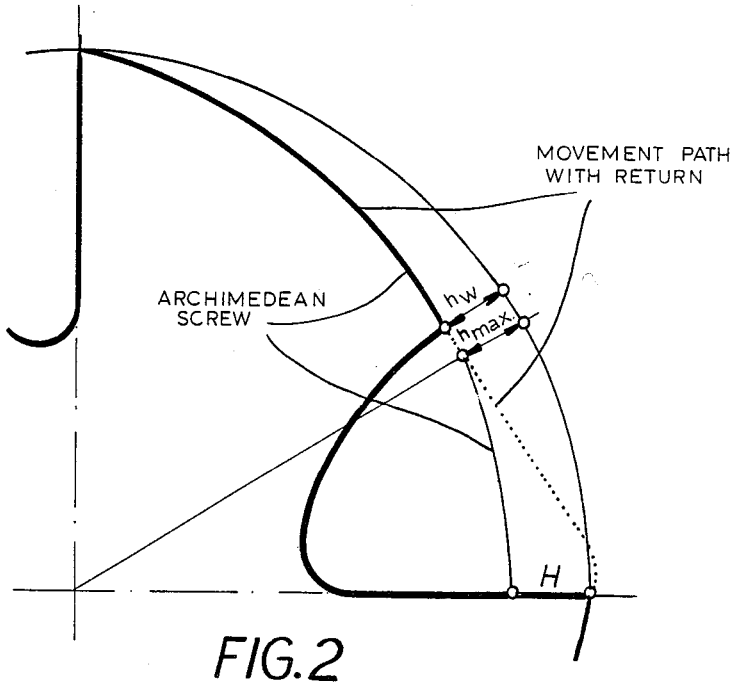
FIG. 2 is an enlarged transverse cross section of a drill for cutting threads and showing the associated undercut dimensions.

FIG. 2 is a quadrant detail showing at a larger scale the course of the curvature, the individual sections and respective parameters, as they can be achieved by the inventive method, of the workpiece 2.

The generating profile parameter H and $h_{max}$ can be programmed from a range of predetermined values.

The technique of producing a screw thread with undercut is described next with particular reference to FIG. 3.

Initially, the position of the longitudinal axis, or the central points, of the trimming disc 3, i.e. axis 6, and of the grinding disc 1. i.e. axis 4, are synchronized in defined relationship by means of a CNC control and the mentioned electronic drive/transmission 20, by way of the associated drives, i.e. M4 and M5 for the trimming disc 3, as well as M8 for the grinding disc 1, and associated sensors or readers WM4, WM5, and WM8. The grinding disc 1 is then given the profile for the desired undercut.

In a first operational step, say rough grinding, the screw thread is ground into the workpiece 2. However, the respective undercut need not be effected at this time.

In a manner analogous to that mentioned earlier, in which the axis of the trimming disc 3 and of the grinding disc 1 are positioned into a defined relationship with respect to one another, now the drives M1 and M2 for the movement of the workpiece 2, and M8 and M3 for the movement of the grinding disc 1, and the associated sensors WM1, WM2, WM8, and WM3 are operational. Thus synchronization is established between drives M1 and M2.

When simultaneously trimming the grinding disc 1 and carrying out the grinding of the undercut profile at the workpiece 2, the drives M5 and M8 must be synchronized with the drives M1 and M2, and the drive M4 must be activated. Trimming of the grinding disc 1 by means of the trimming disc 3 may be done after or during the rough or primary grinding operation.

The screw thread production also includes a finishing grinding carried out in a further operational step by secondary finishing grinding including the respective undercut, by means of the grinding disc 1 having a single turn or multiple generating turns. The drives M1, M2, M3, and M8, as well as the associated sensors or readers are operationally correlated, and synchronization exists between the drives M1, M2 and M8.

On completion of the secondary grinding, the workpiece is replaced by a new workpiece, and the primary grinding of the new workpiece can be achieved substantially without a preceding trimming step.

Exchanging of the workpieces is done in position-coordinated manner, whereby with the first grinding operation the starting points are fixed, i.e. $A_W$ for the workpiece and $S_S$ for the grinding disc, and these are the basis or base line for all dependent movements.

The changes in diameter of the grinding disc 1, due to wear and trimming, are taken into account in the respective automatic control during the determination of the defined relations of the respective control axes.

It has been disclosed in a previous suggestion to use electronic control/transmission means instead of the corresponding mechanical means, and to utilize an electronic follower or control with respect to the workpiece. The preselected control value is a value which is proportional to the rotation or turning movements of the workpiece. As required, further movements in further axes of the workpiece are additively superposed. It is further intended to balance and alleviate the difference due to physical conditions between a momentary position related to a respective control value and a desired actual position (drag distance) by a calculated correction, and this is included in the control parameters.

When machining or forming threads having multiple turns or numerically controlled tool machines, the drag distance changes when the cuts of the individual turns of the screw thread are not carried out with the same velocity. A correction for this can be made in accordance with a prior art proposal, wherein the momentary angle of rotation is compensated by a value which can be calculated taking into account the drag or delay of the advance and the inclination or pitch of the thread.

Figure 3:
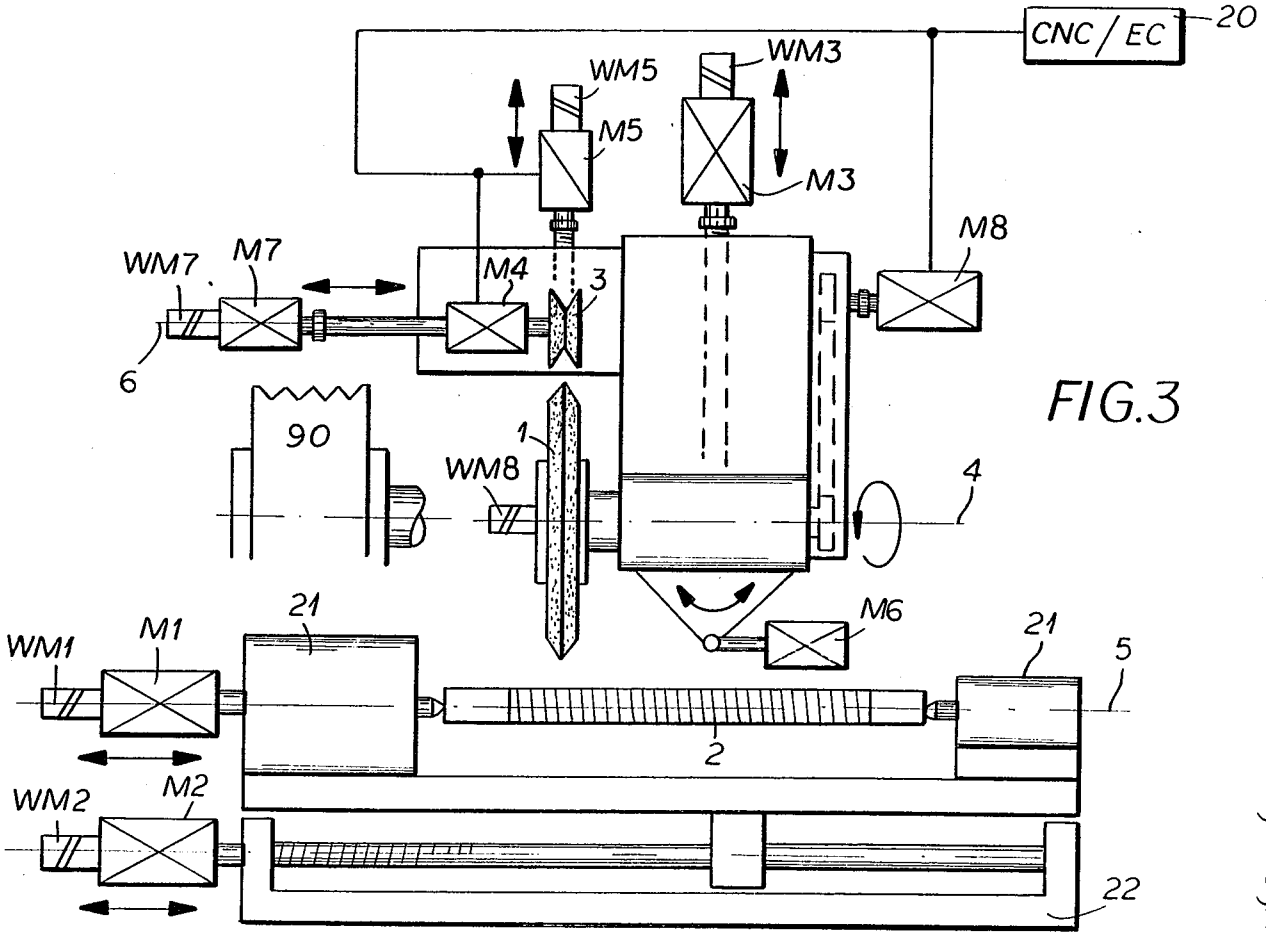
FIG. 3 is a schematic representation of a grinding apparatus and the respective control therefor.

As is indicated in FIG. 3, the workpiece 2 is held between centers 21 for rotation by a respective drive. The centers 21 are mounted on a saddle 22 with drive M2 imparting the respective longitudinal or reciprocating motions.

The drive M6 can be used to carry out pivotal motions for adjustment of the position of the grinding disc 1.

We claim:

1. An apparatus for grinding a workpiece, comprising:

means for mounting an elongated workpiece for an angular displacement about an axis thereof;

a first electric motor operatively connected to said workpiece for angularly displacing said workpiece about said axis;

a second electric motor operatively connected to said means for mounting said elongated workpiece for displacement of said workpiece along said axis thereof;

a grinding wheel having a grinding periphery juxtaposed with said workpiece;

means for mounting said grinding wheel so that it is displaceable toward and away from said workpiece;

a third electric motor opeatively connected to said means for mounting said grinding wheel for displacing said grinding wheel toward and away from said workpiece;

a trimming disk adapted to impart a grinding profile to said periphery of said grinding wheel;

a fourth motor connected to said trimming disk for rotation thereof about an axis of the trimming disk parallel to said axis of said grinding wheel;

means for mounting said trimming wheel for movement perpendicular to said axes relative to said grinding wheel;

a fifth electric motor connected to said means for mounting said trimming disk for displacing same perpendicular to said axes toward and away from said grinding wheel;

means for mounting said grinding wheel and trimming disk for joint swinging movement relative to said workpiece;

a sixth electric motor connected for jointly swinging said grinding wheel and said trimming disk relative to said workpiece;

a seventh electric motor operatively connected with said trimming disk for displacing said trimming disk along the axis of said disk;

an eighth electric motor operatively connected to said grinding wheel for driving said grinding wheel in rotation about the axis thereof; and means connected to all of said motors for electronically synchronizing all of said electric motors to bring said trimming disk into engagement with said grinding wheel to impart said profile thereto and to grind said workpiece to generate archimedean spirals thereto an angularly spaced locations thereon.

2. The apparatus defined in claim 1 wherein at least some of said motors are provided with sensors signalling a position established by the respective motors.

3. A method of grinding a workpiece, comprising the steps of:

(a) mounting an elongated workpiece for angular displacement about an axis thereof by a first electric motor and for displacement along said axis by a second electric motor;

(b) juxtaposing a periphery of a grinding wheel with said workpiece and mounting said grinding wheel so that it is displaceable toward and away from said workpiece by a third electric motor;

(c) juxtaposing with said periphery of said grinding wheel with a trimming disk adapted to impart a configuration to said periphery of said grinding wheel;

(d) mounting said trimming disk for rotation thereof about an axis of the trimming disk parallel to said axis of said grinding wheel by a fourth electric motor, and for movement perpendicular to said axes relative to said grinding wheel by a fifth electric motor;

(e) mounting said grinding wheel and trimming disk for joint swinging movement relative to said workpiece by a sixth electric motor;

(f) mounting said trimming disk for displacement along the axis thereof by a seventh electric motor;

(g) driving said grinding wheel in rotation about the axis thereof with an eighth electric motor; and (h) electronically synchronizing all of said electric motors to bring said trimming disk into engagement with said grinding wheel to impart said profile thereto and to grind said workpiece to generate archimedean spirals thereto at angularly spaced locations thereon.

4. The method defined in claim 3 wherein said profile is a convex generating formation on said grinding wheel, formed by said trimming wheel and extending helically around the periphery of said grinding wheel.

* * * * *